US008057270B2

(12) United States Patent
Shimazu et al.

(10) Patent No.: US 8,057,270 B2
(45) Date of Patent: Nov. 15, 2011

(54) CONTACT DEVICE

(75) Inventors: Hideaki Shimazu, Tokyo (JP); Hiroyuki Nakagawa, Tokyo (JP); Hitoshi Sadakuni, Tokyo (JP); Daisuke Fujita, Tokyo (JP); Tatsuya Hayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/745,282

(22) PCT Filed: Dec. 2, 2008

(86) PCT No.: PCT/JP2008/003548

§ 371 (c)(1),
(2), (4) Date: May 28, 2010

(87) PCT Pub. No.: WO2009/072263

PCT Pub. Date: Jun. 11, 2009

(65) Prior Publication Data

US 2010/0304622 A1 Dec. 2, 2010

(30) Foreign Application Priority Data

Dec. 5, 2007 (JP) ..... 2007-314519

(51) Int. Cl.
*H01R 13/17* (2006.01)

(52) U.S. Cl. ..... 439/827

(58) Field of Classification Search ..... 439/827, 439/843, 816, 840, 909, 852, 849
See application file for complete search history.

(56) References Cited

U.S. PATENT DOCUMENTS

| | | | | |
|---|---|---|---|---|
| 2,914,344 | A * | 11/1959 | Anthes | 285/93 |
| 4,805,943 | A * | 2/1989 | Balsells | 285/318 |
| 4,955,830 | A * | 9/1990 | Fukumoto | 439/821 |
| 5,094,494 | A * | 3/1992 | McConnell | 285/318 |
| 5,308,266 | A * | 5/1994 | Booker | 439/817 |
| 5,545,842 | A * | 8/1996 | Balsells | 174/372 |
| 5,718,459 | A * | 2/1998 | Davie et al. | 285/148.19 |
| 5,816,626 | A * | 10/1998 | Anderson et al. | 285/318 |
| 6,283,642 | B1 * | 9/2001 | Schroeder et al. | 385/78 |
| 6,895,276 | B2 * | 5/2005 | Kast et al. | 607/37 |

(Continued)

FOREIGN PATENT DOCUMENTS

DE 197 18 448 11/1998

(Continued)

*Primary Examiner* — Tulsidas C Patel
*Assistant Examiner* — Harshad Patel
(74) *Attorney, Agent, or Firm* — Oblon, Spivak, McClelland, Maier & Neustadt, L.L.P.

(57) ABSTRACT

A contact device that has decreased contact pressure against a conductor caused by elastic repulsion force of a spring contact, to thereby enable suppressing friction and reducing electrical-resistance. The contact device includes first and second conductors arranged on a same axis and moved in their axis direction to fit to each other, a spring contact fitted to an installation groove of the second conductor, and a conductive contact piece arranged between a fitting face of the first conductors and the spring contact, so that electric current flows in a pair of conductors through the conductive spring contact and the conductive contact piece. The spring contact has an elliptical cross section formed of a bare wire being spirally wound with tilting against the winding axis thereof, and the contact piece is divided into a plurality of segments in a direction of the winding axis of the spring contact, and configured to line-contact or face-contact the other of the conductors.

8 Claims, 7 Drawing Sheets

U.S. PATENT DOCUMENTS

| | | | | |
|---|---|---|---|---|
| 7,274,964 | B2 * | 9/2007 | Balsells | 607/37 |
| 7,429,199 | B2 * | 9/2008 | Burgess | 439/841 |
| 2005/0242910 | A1 | 11/2005 | Balsells | |

FOREIGN PATENT DOCUMENTS

| | | |
|---|---|---|
| JP | 52 138264 | 10/1977 |
| JP | 1 187716 | 7/1989 |
| JP | 3 26929 | 3/1991 |
| JP | 3 203179 | 9/1991 |
| JP | 6 29319 | 4/1994 |
| JP | 7 163023 | 6/1995 |
| JP | 2000 294063 | 10/2000 |
| JP | 2005 176536 | 6/2005 |
| WO | 2005 112055 | 11/2005 |

* cited by examiner

CONTACT DEVICE

TECHNICAL FIELD

The present invention relates to a contact device used in a conductive connection unit of an electrical apparatus.

BACKGROUND ART

In order to improve device-assembly property of electrical apparatus, its conductor is divided into several pieces. Therefore, a contact device for connecting between conductors to each other becomes necessary for easily assembling these conductors. In the contact device, because electric current also flows therethrough similarly to the conductors, in order to prevent heat generation due to electrical resistance, a stable low-electrical-resistance device is required. Moreover, based on a case-by-case system to which the device is applied, the device is required to have a function which absorbs a relative displacement due to size tolerance of the apparatus and/or that generated by thermal expansion/contraction of the conductors depending on its atmospheric condition.

For example, a conventional contact device of a gas-insulated switching apparatus has been configured in such a way that a pair of conductors arranged on the same axis are fitted to each other at their ends in the axis direction, and the conductive contact is arranged in a fitted portion between the conductors, so as to flow current therethrough (for example, refer to Patent Document 1).

The above described contact device disclosed in Patent Document 1 includes at least two kinds of gaps in the fitted portion of the conductor pair, and the gaps are formed by protrusions provided in a cylindrical inner periphery of the conductors. The contact device arranged in the fitted portion of the conductor pair is configured of a coil-spring shaped one having a spring action. A stable contact resistance to the conductor pair can be obtained by a contact load obtained by the spring action. According to such a configuration, in a contact portion of the conductor pair, because a stable contact load can be obtained even though varying the insertion angle of the conductors, a value of stable contact resistance can be obtained.

The spring contact is formed by spirally winding a bare wire constituted by highly electrical-conductive spring material with the wound wire being tilted by an angle less than 90 degrees to its winding axis, so as to be integral and belt-like, and is formed to be circular by jointing its both ends together, which is arranged in a groove provided along the circumferential direction on one of the fitted faces of the conductor pair. Here, the groove is provided in plural numbers along the axis direction, and a plurality of circular spring contacts is arranged in the axis direction.

Because the spring contact is formed by the spiral winding with tilting by the angle less than 90 degrees to the winding axis, its cross section perpendicular to the winding axis becomes elliptical, thereby providing a characteristic in which spring elasticity is provided thereon in the short-axis direction. Thereby, when the spring contact whose cross section is elliptical is fitted into the groove, with the side faces of the spring contact in the short axis direction facing the bottom face of the groove, and arranged in a gap between the pair conductors, elastic repulsion force of the spring contact acts between the spring contact and each of the conductors, providing a low-contact-resistance.

[Patent document 1]

Japanese Patent Application Publication Laid-Open No. 2005-176536

DISCLOSURE OF THE INVENTION

Problems to be Solved by the Invention

The conventional contact device has been configured as described above; therefore, the bare wire of the spring contact and the conductor are made contact to each other, and many contact points are created. However, because the curvature radius of the bare wire of the spring contact is relatively small, the contact area contacting the conductor becomes small; thereby, contact pressure obtained by repulsion force of the spring elasticity is necessarily increased. Therefore, what has been a problem is an increased friction amount according to the increase of the contact pressure. Moreover, there is a problem that powders to be a cause of contact failure are generated by the friction at the contact portion between the contact and the conductor, thereby increasing electrical resistance of the contact device.

An objective of the present invention, which is made to solve the above described problem, is to provide a contact device which has, compared to the conventional device, a decreased contact pressure against a conductor caused by elastic repulsion force of a spring contact, to thereby enable suppressing friction and reducing electrical-resistance.

Means for Solving the Problem

There is provided a contact device according to the present invention, comprising a pair of conductors that have been arranged on the same axis and moved in its axis direction to fit each other, a conductive spring contact arranged along a portion where a fitting face of any one of the conductors and a plane crossing to the axis direction of the pair of conductors are crossing to each other, and a conductive contact piece arranged between a fitting face of the other of the conductors and the spring contact, so that an electric current flows between the pair of conductors through the conductive spring contact and the conductive contact piece, the contact device characterized in that the spring contact is formed of a bare wire being spirally wound with tilting against the winding axis thereof, and has an elliptical cross section, and the contact piece is divided into a plurality of segments in a direction of the winding axis of the spring contact, and line-contacts or face-contacts said other of the conductors.

Advantageous Effect of the Invention

According to the present invention, the contact pressure against the conductor due to the elastic repulsion force of the spring contact can be reduced, and the friction between the contact piece and the conductor can be suppressed. Moreover, suppressing the friction results in preventing the increase of the electrical resistance of the contact device.

EXPLANATION OF REFERENCES

1: First conductor, 2: Second conductor, 1*a* and 2*a*: Conductor-side installation groove, 3: Spring contact, 4: Contact piece, 4*a*: Contact-piece-side installation groove, 5: Connection unit

BEST MODE FOR CARRYING OUT THE INVENTION

Embodiment 1

Figure 1:
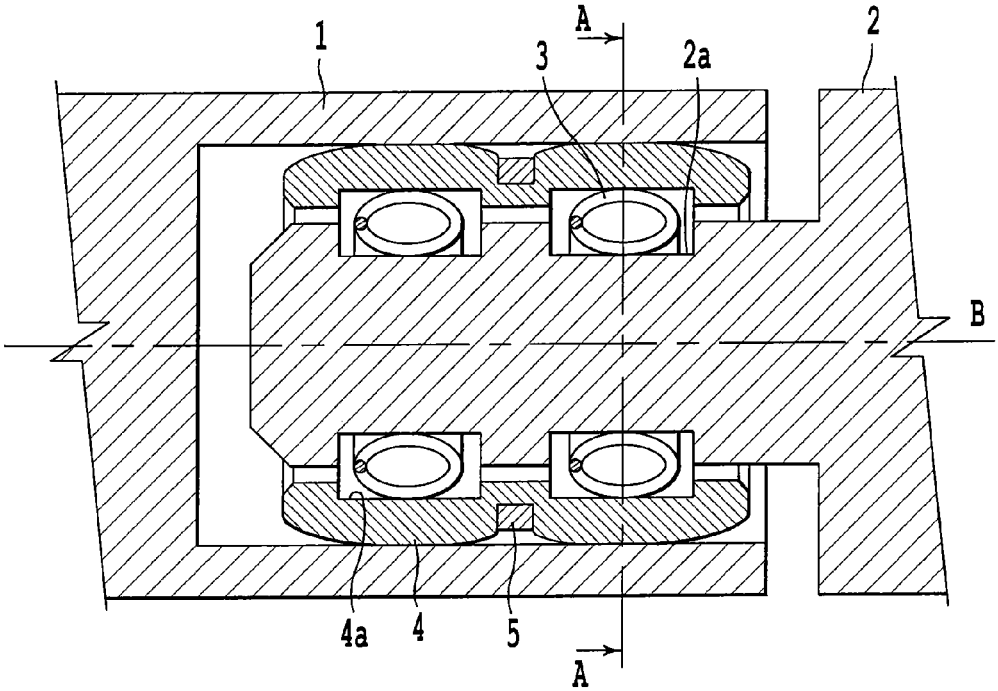
FIG. 1 is a cross-sectional configuration view illustrating a configuration of a contact device according to Embodiment 1 of the present invention.
Figure 2:
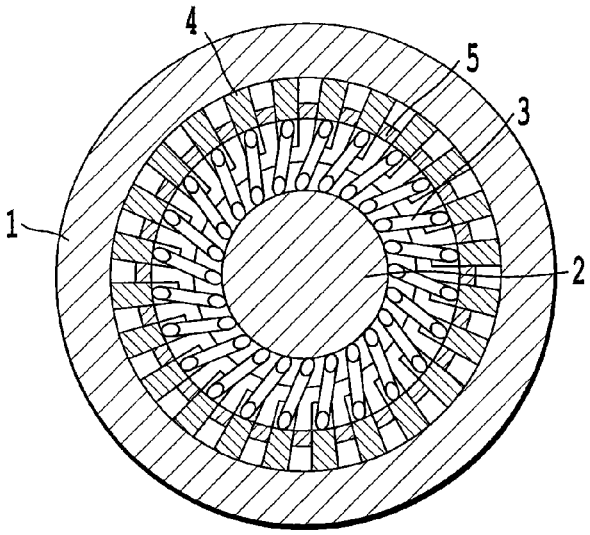
FIG. 2 is a cross-sectional configuration view taken along an A-A line in FIG. 1.

FIG. 1 is a cross-sectional configuration view illustrating a configuration of a contact device according to Embodiment 1 of the present invention, and FIG. 2 is a cross-sectional configuration view taken along an A-A line in FIG. 1.

In FIG. 1, a first conductor 1 and a second conductor 2 form as a pair a conductive path. The first conductor 1 and the second conductor 2, which are columnar, are arranged, in order to configure the conductive path, on the same axis (on line B). The first conductor 1 has its end portion of a cylindrically hollow structure, while the second conductor 2 has its end portion of a structure smaller in diameter, thus allowing/enabling the small-diameter portion of the second conductor 2 to be fitted into the hollow portion of the first conductor 1. The inner diameter of the first conductor 1 is designed to be larger compared to the outer diameter of the small-diameter portion of the second conductor 2.

Conductor-side installation grooves 2*a* are provided along the circumferential direction on the outer face of the small-diameter portion of the second conductor 2. Spring contacts 3 are located in the installation grooves 2*a* whose cross-sectional shapes (cross-sectional shapes perpendicular to the circumferential direction) are rectangular, and the second conductor 2 and the spring contacts 3 are electrically connected to each other.

Conductive contact pieces 4, for example, made of metal, which are segmented into a plurality of segments in the winding axis direction of the spring contacts 3 (circumferential direction of the first conductor 1 or the second conductor 2), are arranged between the spring contacts 3 and the inner peripheral face of the first conductor 1, so as to cover the spring contacts 3, and each of the contact pieces 4 is electrically connected to the spring contacts 3 and to the first conductor 1.

Contact-piece-side installation grooves 4*a* are extendedly provided in the circumferential directions on the inner peripheral faces of the contact pieces 4. The cross-sectional shape (cross-sectional shape perpendicular to the circumferential direction) of the installation grooves 4*a* is rectangular, and the spring contacts 3 are located in the installation grooves 4*a*.

Figure 3:
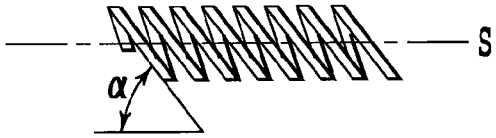
FIG. 3 is a side view illustrating a part of a spring contact according to Embodiment 1 of the present invention.

FIG. 3 is a side view illustrating a part of the spring contact, in which the spring contact is formed by spirally winding a bare wire constituted by conductive spring material with the wound wire being tilted by an angle ($\alpha$) less than 90 degrees against its winding axis (line S), so as to be integral and belt-like. In this embodiment, the thus obtained spring contact is formed by connecting its both ends into the circular spring contact 3, and is arranged, as represented in FIG. 1 and FIG. 2, along the installation groove 2*a*, in the circumferential direction of the second conductor 2. Here, if the spring contact 3 is made circular by connecting the ends by welding, there is no possibility of its being detached during the assembling thereof however, the spring contact may be arranged by directly winding it without the welding.

The installation grooves 2*a* are provided in a plural number at predetermined positions in the axis (line B) direction, and the plurality of the circular spring contacts 3 are arranged in the axis (line B) direction.

Here, the number of the installation groove 2*a* may be single, or one spring contact 3 may be configured to be arranged in the single installation groove 2*a* provided at a predetermined position in the axis (line B) direction.

Because the spring contacts 3 are each formed by the spiral winding with tilting by the angle less than 90 degrees against the winding axis, its cross section perpendicular to the winding axis becomes elliptical, thereby providing a characteristic showing spring elasticity in the short axis direction. Therefore, the spring contacts 3 are arranged between the second conductor 2 and the contact pieces 4, with the spring contacts being embedded in the installation grooves 2*a* so that side faces in the short axis direction of the elliptical cross sections of the spring contacts 3 are contacted to the bottom faces of the installation grooves 2*a*, as well as being embedded in the installation grooves 4*a* of the contact pieces 4. According to the above described configuration, the elastic repulsion force of the spring contacts 3 acts between the spring contacts 3 and the second conductor 2, between the spring contacts 3 and the contact pieces 4, and between the contact pieces 4 and the first conductor 1, thereby providing low electrical contact resistance.

Here, each size of the conductor-side installation grooves 2*a* and the contact-piece-side installation grooves 4*a* is assumed to be designed so that the sum of the depth of the grooves 2*a* and that of the grooves 4*a* becomes smaller than the outer diameter, in the short axis direction, of the spring contacts 3.

The contact pieces 4 are each constituted of a plurality of contact piece segments whose number is the same as the spring-winding turn number of each spring contact 3, and are arranged on the outer periphery of the spring contacts 3 in a manner that each one of the contact piece segments 4 corresponds to each one of winding turns of the spring contact 3, so that the inner peripheral face of each of the contact piece segments 4 and each bare wire of the spring contact 3 are electrically connected to each other. Moreover, the outer peripheral face of each of the contact piece segment 4 and the inner peripheral face of the first conductor 1 are electrically connected to each other.

In order to arrange the plurality of the contact piece segments 4, so as to correspond to the bare-wire positions of the spring contact 3 that are disposed along the circumferential direction and are placed at a regular pitch, at the same pitch as that of the bare wire, the plurality of the contact piece segments 4 are connected by a connection unit 5.

Here, in FIG. 1, the contact piece segments of the plural contact pieces 4 are shaped to join together in the axis direction, corresponding to two spring contacts 3 disposed in the axis direction, and the connection unit 5 is configured to connect a plurality of the thus-joined contact piece segments 4 disposed in the circumferential direction, at the center thereof.

Figure 4A:
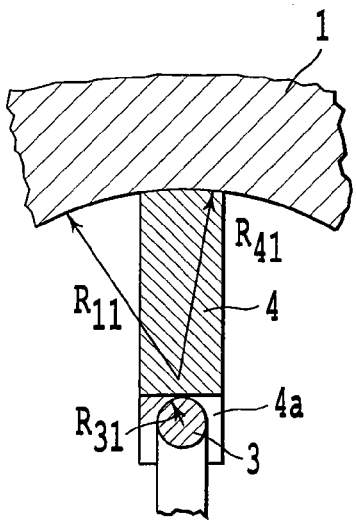
FIG. 4 is magnified views magnifying and representing a cross section of a contact portion where the spring contact, a contact piece, and a first conductor according to Embodiment 1 of the present invention are contacted.
Figure 4B:
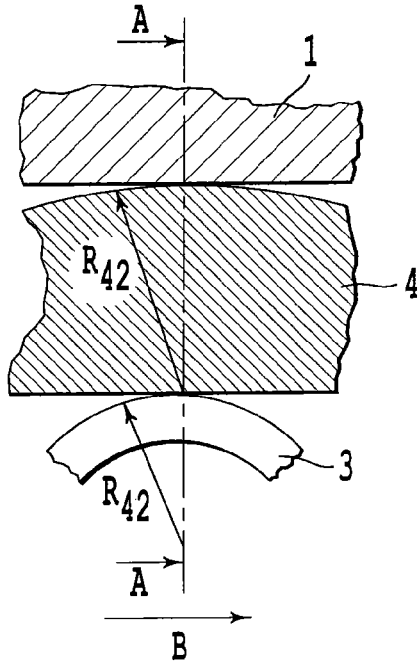

FIG. 4 is views magnifying a portion where the spring contacts 3, the contact pieces 4, and the first conductor 1 are contacted, in which FIG. 4(*a*) represents a cross section perpendicular to the axis direction of the first conductor 1 and the second conductor 2, and FIG. 4(*b*) is a magnified view of a cross section along the axis direction (arrow B). Here, FIG. 4(*a*) represents a cross section at A-A line in FIG. 4(*b*).

The contact pieces 4 are formed of a plate-like shape and made of a material having conductivity. The contact piece segments 4 have curved faces that contact the first conductor 1, and each of the contact piece segments 4 and the first conductor 1 line-contact to each other in a direction perpendicular to the axis direction. That is, each of the curved faces, as represented in FIG. 4(*a*), has a curvature radius $R_{41}$ corresponding to a radius $R_{11}$ of the inner peripheral face of the first conductor 1 in the cross section perpendicular to the axis direction, and, as represented in FIG. 4(*b*), has, in a cross section along the axis direction, a curvature radius $R_{42}$ larger than a curvature radius $R_{32}$ in the short axis direction of an elliptical cross section of the spring contacts 3.

According to such a configuration, because the contact state of the contact pieces 4 and the first conductor 1 becomes a line-contact one, their contact area increases in comparison with the case where the spring contact and the conductor are point-contacted to each other as in the conventional configuration, resulting in reducing the surface pressure against the first conductor 1 caused by the elastic repulsion force of the spring contacts 3. By reducing the surface pressure against the first conductor 1, the assembling of the conductor becomes easier, and an effect of reducing the friction between the contact pieces 4 and the first conductor 1 during the assembling can also be expected. Moreover, due to the prevention of the friction, the increase in electrical-resistance of the contact device is prevented, thus allowing a longer-term usage of the contact device.

Because the contact state of the contact pieces 4 and the first conductor 1 is a line-contact one in the direction perpendicular to the axis direction, an effect can be obtained that foreign substances causing contact failure when relative displacement occurs by thermal expansion/contraction, of the conductor depending on the atmospheric condition, are removed from the contacting portion.

Figure 5:
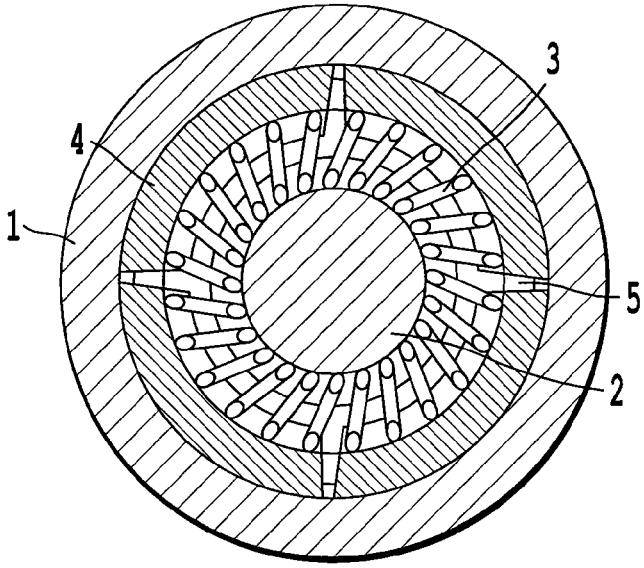
FIG. 5 is a cross-sectional configuration view illustrating another configuration of the contact device according to Embodiment 1 of the present invention.

Here, in the above embodiment, as represented in FIG. 2, the plurality of the contact piece segments 4 whose number is the same as the spring-winding turn number of each spring contacts 3 are arranged corresponding to positions of the bare wire of the spring contact 3, and the respective contact piece segments 4 are configured to join together by the connection unit 5; however, as represented in FIG. 5, a several number (four in FIG. 5) of the contact piece segments 4 each corresponding to the plural winding turn number of the spring contact 3 may be arranged to be connected together by the connection unit 5.

Embodiment 2

Figure 6:
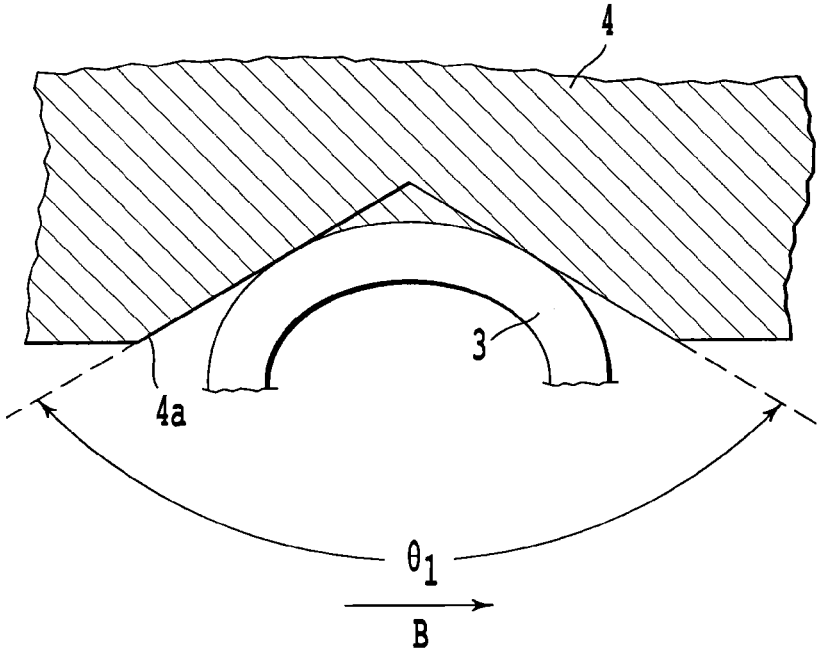
FIG. 6 is a magnified view magnifying and representing a cross section of a contact portion of a spring contact and a contact piece according to Embodiment 2 of the present invention.

FIG. 6 is a view illustrating a shape of an installation groove of a contact piece according to Embodiment 2 of the present invention, in which a portion, where the spring contacts 3 and the contact pieces 4 contact, in a cross section along the axis direction (arrow B) of the first conductor 1 and the second conductor 2, is magnified and illustrated.

In Embodiment 1, the cross-sectional shape of the installation grooves 4*a* of the contact pieces 4 is rectangular. In Embodiment 2, the cross-sectional shape of the installation grooves 4*a* (cross-sectional shape perpendicular to an extending direction of the installation grooves 4*a*) is a V-shaped one whose opening angle is $\theta_1$. The groove angle $\theta_1$ of the installation grooves 4*a* having V-shaped cross sections has an arbitrary angular value larger than 0 degree and smaller than 180 degrees.

The other configurations and functions are similar to those of the contact device represented in Embodiment 1.

According to such a configuration, the spring contacts 3 each contact dual positions of both side walls of each of the installation grooves 4*a* of the contact pieces 4; that is, the number of the contact positions between each of the spring contacts 3 and each of the contact pieces 4 can be set to be dual. Therefore, the contact areas between the spring contacts 3 and the contact pieces 4 increase compared to those in a single-contact state; as a result, the contact electrical resistance can be reduced. Moreover, the current paths inside the spring contacts 3 are shortened; as a result, the electrical resistance between the second conductor 2 and the contact pieces 4 can be reduced.

Embodiment 3

Figure 7:
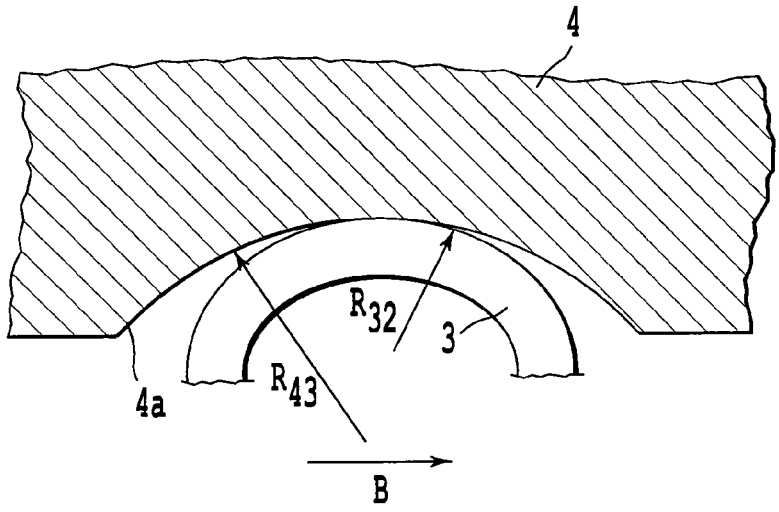
FIG. 7 is a magnified view magnifying and representing a cross section of a contact portion of a contact piece and a spring contact according to Embodiment 3 of the present invention.

FIG. 7 is a view illustrating a shape of an installation groove of a contact piece according to Embodiment 3 of the present invention, in which a portion, where the spring contacts 3 and the contact pieces 4 contact, in a cross section along the axis direction (arrow B) of the first conductor 1 and the second conductor 2 is magnified and illustrated.

In Embodiment 2, the cross-sectional shape of the installation grooves 4*a* provided on the contact pieces 4 is given to have a V-shaped (or U-shaped) concave curved face. In Embodiment 3, the installation grooves 4*a* of the contact pieces 4 are circular in cross-sectional shape perpendicular to the extending direction of the installation grooves 4*a*. The other configurations and functions are similar to those of the contact device represented in Embodiment 1.

As represented in FIG. 7, when the curvature radius $R_{43}$ of the circular curved face of the installation grooves 4*a* is set larger than that of the bare wire $R_{32}$ of the spring contacts 3, although the number of contact portions is singular for each of contact regions between the spring contacts 3 and the installation grooves 4*a*, the contact area of the contact portion increases. Here, in this case, the smaller the difference between these curvature radiuses $R_{32}$ and $R_{43}$, the larger contact area can be obtained.

Therefore, on this occasion, the contact areas between the contact pieces 4 and the spring contacts 3 also increase, to thereby reduce the electrical resistance between the contact pieces 4 and the second conductor 2.

Embodiment 4

Figure 8:
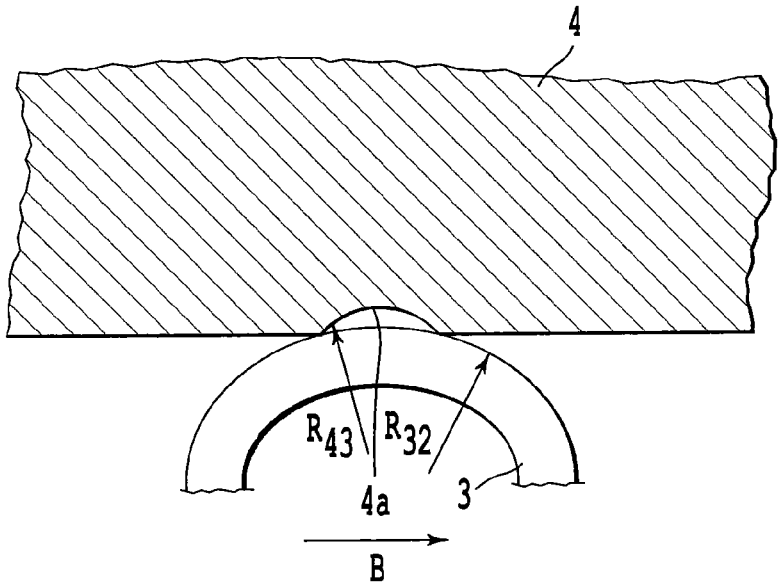
FIG. 8 is a magnified view magnifying and representing a cross section of a contact portion of a contact piece and a spring contact according to Embodiment 4 of the present invention.

FIG. 8 is a view illustrating a shape of an installation groove of a contact piece according to Embodiment 4 of the present invention, in which a portion, where the spring contacts 3 and the contact pieces 4 contact, in a cross section along the axis direction (arrow B) of the first conductor 1 and the second conductor 2 is magnified and illustrated. In Embodiment 4, similar to Embodiment 3, the installation grooves 4*a* of the contact pieces 4 are circular in cross-sectional shape perpendicular to the extending direction of the installation grooves 4*a*; however, as represented in FIG. 8, the curvature radius $R_{43}$ of the circular curved face of the installation grooves 4*a* is made smaller than the curvature radius $R_{32}$ of the bare wire of the spring contacts 3. According to this configuration, similarly to that in Embodiment 2, because of dual contact established in each of the contact portions between the bare wires of the spring contacts 3 and the installation grooves 4*a*, the contact area of the spring contacts 3 and the contact pieces 4 increases compared to that of the single-contact state, resulting in reduction of the contact resistance between the spring contacts 3 and the contact pieces 4, thereby preventing heat generation from the spring contacts 3.

Here, in this embodiment, although the spring contacts 3 cannot be embedded inside the installation grooves 4*a*, the spring contacts 3 can be prevented from moving in the axis direction thereof by the installation grooves 2*a* and 4*a*.

Embodiment 5

Figure 9:
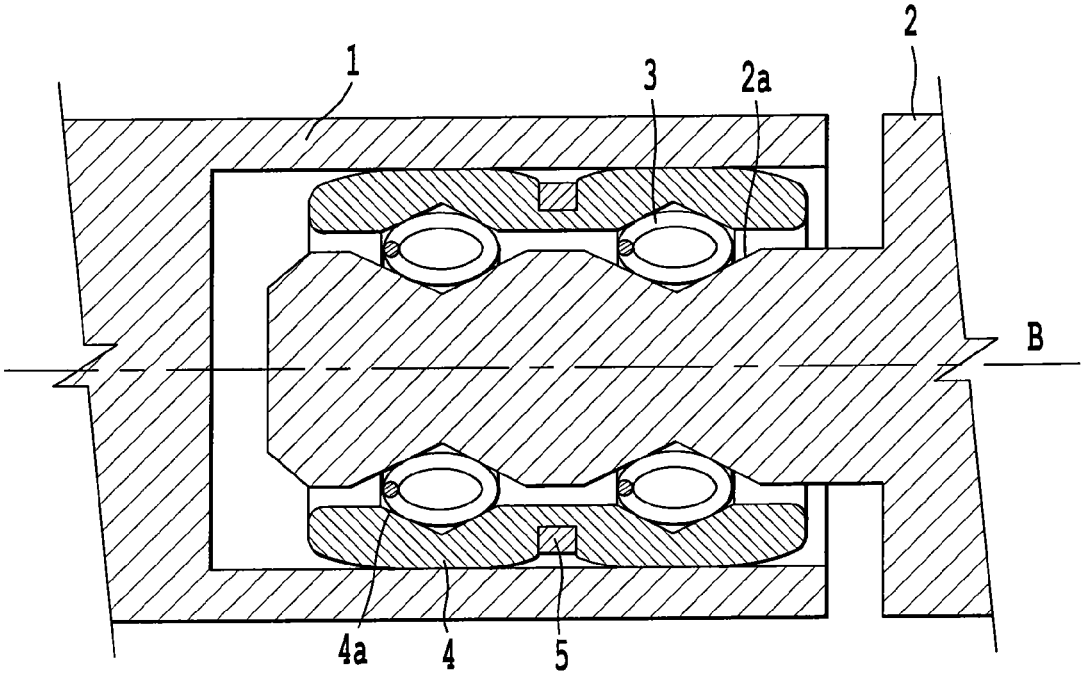
FIG. 9 is a cross-sectional configuration view illustrating a configuration of a contact device according to Embodiment 5 of the present invention.

FIG. 9 is a cross-sectional configuration view illustrating a configuration of a contact device according to Embodiment 5 of the present invention.

While shown in Embodiment 2 is the installation grooves 4*a* of the contact pieces 4 which is V-shaped in cross section, in Embodiment 5, the cross section of the installation grooves 2*a* of the second conductor 2 where the spring contacts 3 are embedded (cross section perpendicular to the extending direction of the installation grooves 2*a*), is also designed to be similarly V-shaped. The groove angle of the V-shaped cross-sectional installation grooves 2*a* is an arbitrary angle larger than 0 degree and smaller than 180 degrees.

The other configurations and functions are similar to those of the contact device represented in Embodiment 2.

According to such configuration, each of the spring contacts 3 contacts dual points of both side walls of each of the installation grooves 4*a* of the contact pieces 4, and also contacts dual points of both side walls of each of the installation grooves 2*a* of the second conductor 2, that is, the number of the contact portions of each of the spring contacts 3 to each of the contact pieces 4, and to the second conductor 2 can be respectively made to be dual. Therefore, the contact area of the spring contacts 3 and the contact pieces 4 increases compared to that of the single-contact states, resulting in reduction of the contact resistance. Moreover, the conductive path inside the spring contact is shortened, to thereby reduce the electrical resistance between the second conductor 2 and the contact pieces 4.

Here, in FIG. 9, both of the cross-sectional shapes of the installation grooves 4*a* of the contact pieces 4 and the installation grooves 2*a* of the second conductor 2 are made to be V-shaped; however, only the installation grooves 2*a* of the second conductor 2 may be made to be V-shaped. The cross-sectional shapes of the installation grooves 4*a* and 2*a* may be made to be curved providing a circular face as represented in Embodiments 3 and 4.

Embodiment 6

Figure 10:
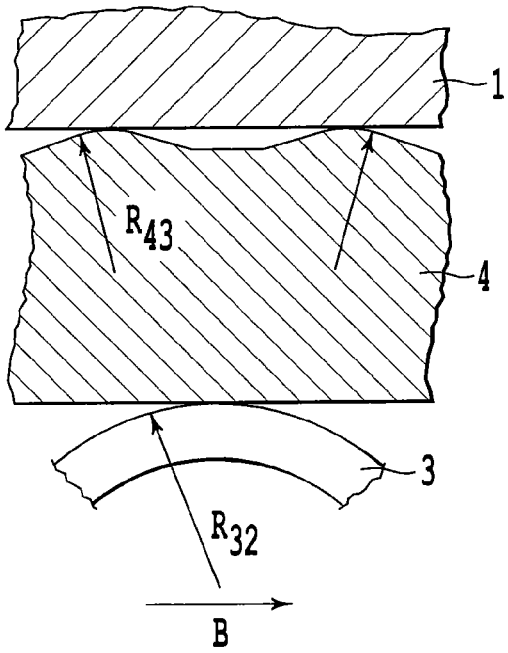
FIG. 10 is a magnified view magnifying and representing a cross section of a contact portion of a contact piece and the first conductor according to Embodiment 6 of the present invention.

FIG. 10 is a view illustrating a shape of a contact portion of the contact piece and the first conductor according to Embodiment 6 of the present invention, in which a portion, where the spring contacts 3, the contact pieces 4, and the first conductor 1 contact, in a cross section along the axis direction (arrow B) of the first conductor 1 and the second conductor 2 is magnified and illustrated.

In Embodiment 1, as represented in FIG. 4(*b*), the number of the contact portions where each of the contact piece segments 4 and the first conductor 1 is line-contacted is designed to be single in the axis direction for each of the spring contacts 3; however, the contact device according to Embodiment 6 has two or more contact portions in the axis direction for each of the spring contacts 3.

Here, in FIG. 10, regarding a plurality of the contact piece segments 4 arranged in the circumferential direction for each of the spring contacts 3, it is configured that each of the contact piece segments 4 and the first conductor 1 are to have a contact region including two line-contacted portions.

It can be realized to increase the number of the line-contact portions between each of the contact pieces 4 and the first conductor 1, by providing, for example, as represented in FIG. 10, two convex curved faces whose curvature radius $R_{42}$ along the axis direction is smaller than the curvature radius $R_{32}$ of the spring contacts 3, on the opposite face of the contact pieces 4 to the first conductor 1. The other configurations and functions are similar to those of the contact devices represented in Embodiments 1 to 5.

According to such a configuration, the contact areas between the contact pieces 4 and the first conductor 1 increase, and the contact resistance can be reduced. Moreover, because the contact pressure is further decreased, the friction between the contact pieces 4 and the first conductor 1 can be suppressed.

Embodiment 7

Figure 11:
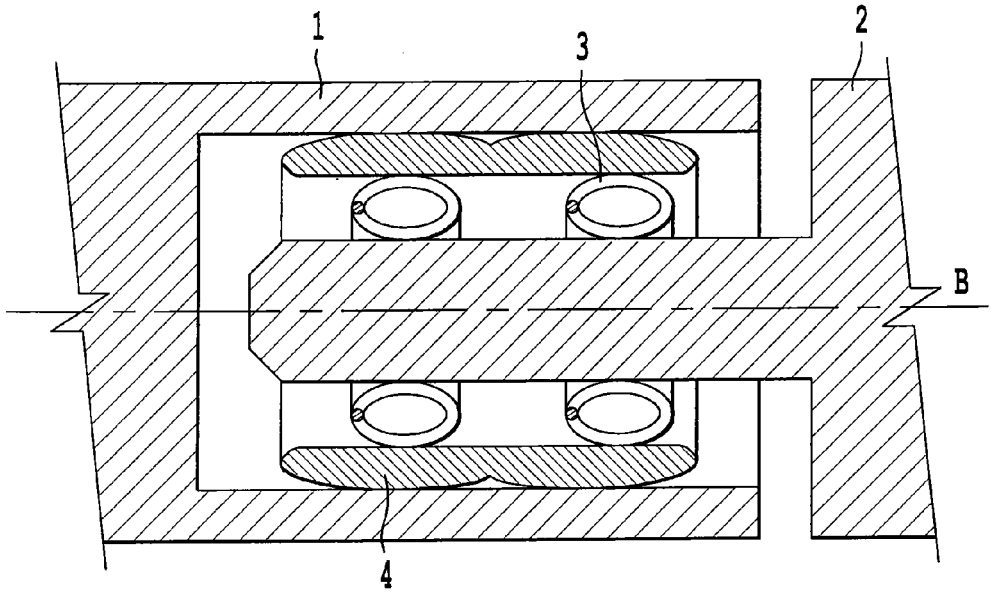
FIG. 11 is a cross-sectional configuration view illustrating a configuration of a contact device according to Embodiment 7 of the present invention.

FIG. 11 is a cross-sectional configuration view illustrating a configuration of a contact device according to Embodiment 7 of the present invention.

In Embodiments 1 to 6, the devices are represented in which the installation grooves 2*a* and 4*a* are provided on the contact pieces 4 and the second conductor 2 for defining the arrangement positions of the spring contacts 3; however, in Embodiment 7, the spring contacts 3 are held at predetermined positions of the second conductor 2 by way of the elastic force of the spring contacts 3 without providing such installation grooves 2*a* and 4*a*, whereby the spring contacts 3 are sandwiched between the contact pieces 4 and the second conductor 2.

The other configurations and functions are similar to those of the contact devices represented in Embodiments 1 and 6.

Also, in such a configuration, the contact state of the contact pieces 4 and the first conductor 1 becomes a line-contact one, and thus the surface pressure against the conductor 1 due to the elastic repulsion force of the spring contact can be reduced, thereby reducing the friction between the contact pieces 4 and the first conductor 1.

Here, in FIG. 11, the installation grooves 2*a* or 4*a* may be provided, on only one of the contact pieces 4 and the second conductor 2, for defining the arrangement position of the spring contacts 3.

Embodiment 8

Figure 12:
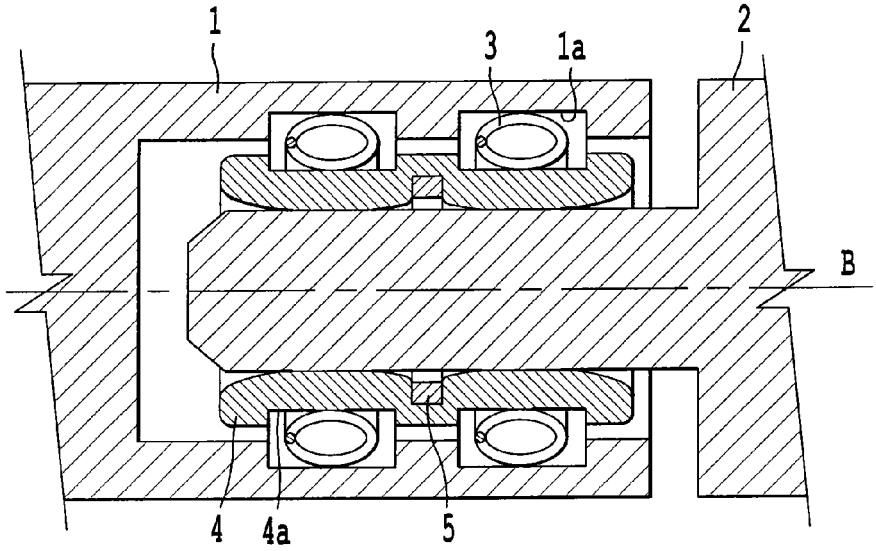
FIG. 12 is a cross-sectional configuration view illustrating a configuration of a contact device according to Embodiment 8 of the present invention.

FIG. 12 is a cross-sectional configuration view illustrating a configuration of a contact device according to Embodiment 8 of the present invention.

In Embodiments 1 to 6, the configurations of arranging the spring contacts 3 between the second conductor 2 and the contact pieces 4 are represented, whereas, in Embodiment 8, the spring contacts 3 are arranged between the first conductor 1 and the contact pieces 4. That is, as represented in FIG. 12, conductor-side installation grooves 1*a* are formed on the inner peripheral face of the hollow portion of the first conductor 1, and the spring contacts 3 are arranged to be located in the conductor-side installation grooves 1*a* of the first conductor 1 and to be covered by the installation grooves 4*a* of the contact pieces 4.

The contact pieces 4 are each constituted of a plurality of contact piece segments whose number is the same as the spring-winding turn number of each spring contact 3, and are arranged on the inner periphery of the spring contacts 3, in a manner that each one of the contact piece segments 4 corresponds to each one of winding turns of the spring contact 3, and the contact piece segments 4 are arranged at a regular interval so as to cover the spring contacts 3. In order to arrange a plurality of the contact piece segments 4, at the same interval as that of the bare wire of the spring contact 3 that forms lines at a regular interval along the circumferential direction, and in place corresponding to the positions of the bare wire lines, the plurality of the contact pieces 4 are connected by the connection unit 5. Each outer peripheral face of the contact piece segments 4 and the bare wire of the spring contact 3 are electrically connected to each other, and each inner peripheral face of the contact piece segments 4 and the outer peripheral face of the second conductor 2 are electrically connected to each other.

Figure 13A:
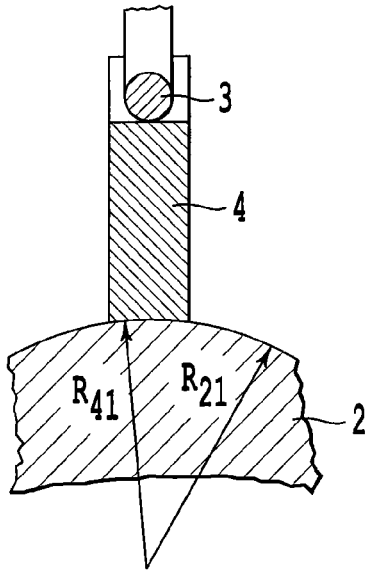
FIG. 13 is magnified views magnifying and representing a cross section of a contact portion where a spring contact, contact pieces, and a second conductor according to Embodiment 8 of the present invention are contacted.
Figure 13B:
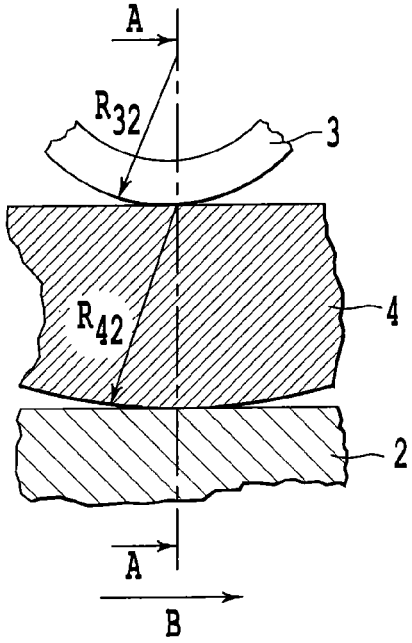

FIG. 13 shows views of a portion where the spring contacts 3, the contact pieces 4, and the second conductor 2 contact is magnified and illustrated, where FIG. 13(*a*) is a magnified view illustrating a cross section perpendicular to the axis direction of the first conductor 1 and the second conductor 2, while FIG. 13(*b*) is that along the axis direction (arrow B). Here, FIG. 13(*a*) represents the cross section at A-A line drawn in FIG. 13 (*b*).

Each contact piece segment 4 has a face as curved one to be in contact with the second conductor 2, and the contact piece segments 4 and the second conductor 2 are line-contacted in a direction perpendicular to the axis direction. That is, as represented in FIG. 13(*a*), the curved face has a cross section perpendicular to the axis direction of the curvature radius $R_{41}$ corresponding to the radius $R_{21}$ of the outer peripheral face of the smaller diameter portion of the second conductor 2, while, as represented in FIG. 13(*b*), the face has a cross section along the axis direction of the curvature radius $R_{42}$ larger than the curvature radius $R_{32}$, in the short axis direction, of an ellipsoidal cross section of the spring contacts 3.

According to such a configuration, the contact state of the contact pieces 4 and the second conductor 2 becomes a line-contact one, and thus the surface pressure against the second conductor 2 due to the elastic repulsion force of the spring contacts 3 can be reduced. By reducing the surface pressure against the second conductor 2, an effect can be expected that the assembling of the conductor becomes easier as well as the friction between the contact pieces 4 and the second conductor 2 is reduced during the assembling.

Here, in each of the above embodiments, the spring contacts 3 are configured to be arranged along the plane perpendicular to the axis direction of the conductors 1 and 2; however, the spring contacts 3 may be arranged along any plane crossing to the axis direction of the conductors 1 and 2.

In Embodiments 1 to 7, the devices are represented in which the contact piece segment 4 is configured to have the face, opposite to the first conductor 1, of a convex curved one having a curvature radius also in the axis direction, and the contact state of the contact piece segment 4 and the first conductor 1 is a line-contact one; however, the contact piece segment 4 may be configured so that its face opposite to the first conductor 1 includes a flat face in the axis direction, at least at a portion to be in contact with the first conductor 1 so that the contact state of the contact pieces 4 and the first conductor 1 is a plane-contact one. According to such a configuration, the surface pressure against the first conductor 1 due to the elastic repulsion force of the spring contacts 3 can be reduced; therefore, an effect can be expected that the friction between the contact pieces 4 and the first conductor 1 during the assembling is reduced.

Similarly, in Embodiment 8, the device are represented in which the contact state of the contact piece segment 4 and the second conductor 2 is a line-contact one; however, the contact piece segment 4 may be configured so that its face opposite to the second conductor 2 includes a flat face in the axis direction, at least at a portion to be in contact with the second conductor 2 so that the contact state of the contact pieces 4 and the second conductor 2 is a plane-contact one. According to the configuration, the surface pressure against the second conductor 2 due to the elastic repulsion force of the spring contacts 3 can be reduced; therefore, an effect can be expected that the friction between the contact pieces 4 and the second conductor 2 during the assembling is reduced.

Moreover, in Embodiments 1 to 8, the first conductor 1 as well as the second conductor 2 is made to be columnar; however, the conductors may be another cylindrical shape.

Furthermore, it may be so configured that the first conductor 1 is formed of a flat plate having a U-shaped cross section in its end portion, the second conductor 2 is formed of a flat plate which can be inserted into the gap inside the U-shaped portion of the first conductor 1, the spring contact is provided, along a direction perpendicular to the insertion direction of the second conductor, on an insertion face of one of the conductors (top or bottom face of the second-conductor edge or inner face of the U-shaped portion of the first conductor), and the conductive contact piece is provided between the spring contact and the other one of the conductors, whereby electric current flows between a pair of conductors through the spring contact and the contact piece.

What is claimed is:

1. A contact device for a coaxial pair of axially elongated conductors which are movable in their axis direction to fit with each other, the contact device comprising:

a pair of axially elongated conductors comprising a first conductor and second conductor;

a fitting face in the first conductor for fitting with a fitting face of the second conductor when the first and second conductors are moved in their axis direction to fit with each other;

an annular groove provided at the fitting face of one of said first and second conductors;

a conductive piece arranged circumferentially around one of said first and second conductors, wherein the conductive piece is circumferentially divided into a plurality of segments, each of the segments of the conductive piece having a groove, wherein the grooves of said segments faces the annular groove of one of said first and second conductor; and a spirally wound annular conductive spring contact formed of bare wire tilted to have an elliptical cross section, wherein the spirally wound annular conductive spring contact is located in a space formed by the annular groove and the grooves of the plurality of conductive piece segments which face the annular groove, wherein the conductive piece segments form a line-contact or face-contact with the other of the first and second conductors when the first and second conductors are moved in their axis direction to fit with each other, thereby providing an electrical connection between the first and second conductors.

2. A contact device as recited in claim 1, wherein the spring contact contacts the bottom of the respective annular groove or grooves in the conductive piece segments at two portions.

3. A contact device as recited in claim 2, wherein the at least one of the annular groove or the grooves in the conductive piece segments has a V-shaped concave curved face.

4. A contact device as recited in claim 1, wherein at least one of the annular groove or the grooves in the conductive piece segments has a cross section, perpendicular to an extending direction of the groove, of a concave curved face, wherein a curvature radius of the curved face is larger than a curvature radius of the elliptical spring contact at the short elliptical axis thereof.

5. A contact device as recited in claim 1, wherein a face of each of said contact piece segments facing the other of the first and second conductors is curved, wherein the contact piece segment and the other of the first and second conductors exhibit line-contact with each other in a direction crossing the axis direction.

6. A contact device as recited in claim 5, wherein the curved face of each of said contact piece segments facing the other of the first and second conductors has a curvature radius in cross section along the axis direction that is larger than a curvature radius of the elliptical spring contact at the short elliptical axis thereof.

7. A contact device as recited in claim 5, wherein the number of contact portions where each contact piece segment and the other of the first and second conductors exhibit line-contact to each other in the axis direction is two or more.

8. A contact device as recited in claim 1, wherein the number of the contact piece segments is the same as that of spring winding turns of the spring contact, wherein a connection unit connects the contact piece segments to maintain the segments at pitches corresponding to pitches of the turns of the spring contact.

* * * * *